United States Patent [19]

Morel

[11] Patent Number: 4,779,774

[45] Date of Patent: Oct. 25, 1988

[54] TELESCOPIC CAPSULE FOR TUBES OR FLASKS

[76] Inventor: Simone Morel, 15 rue du Faubourg de Paris, 51210 Montmirail, France

[21] Appl. No.: 931,028

[22] Filed: Nov. 17, 1986

[51] Int. Cl.[4] ..... B65D 3/00

[52] U.S. Cl. ..... 222/522; 222/561

[58] Field of Search ..... 222/153, 498–499, 222/522–524, 526, 538, 559, 561

[56] References Cited

U.S. PATENT DOCUMENTS

| | | | |
|---|---|---|---|
| 1,862,973 | 6/1932 | McDonald | 222/522 |
| 2,142,293 | 1/1939 | Waite | 222/522 |
| 3,884,390 | 5/1975 | Hazard | 222/522 X |
| 3,915,359 | 10/1975 | Feldman | 222/522 X |
| 3,955,716 | 5/1976 | Goncalves | 222/153 |

FOREIGN PATENT DOCUMENTS

| | | | |
|---|---|---|---|
| 2211277 | 3/1972 | Fed. Rep. of Germany | 222/522 |
| 1278928 | 11/1961 | France | 222/522 |

*Primary Examiner*—Michael S. Huppert

*Attorney, Agent, or Firm*—Browdy and Neimark

[57] ABSTRACT

The telescopic capsule for a tube or flask comprises a telescopic tube obturated by a top forming plate provided with a lateral aperture for passage, in an open position, of a product contained in the tube or flask. The telescopic tube slides in a ring or envelope of the tube or flask and the telescopic tube is rigidly connected to an operating push-piece movable in a guide and is provided with at least one stop protrusion for preventing an ejection of the telescopic tube.

3 Claims, 4 Drawing Sheets

7
3
30
8
10
9
1
13
31
35
32
1a
11

FIG. 8
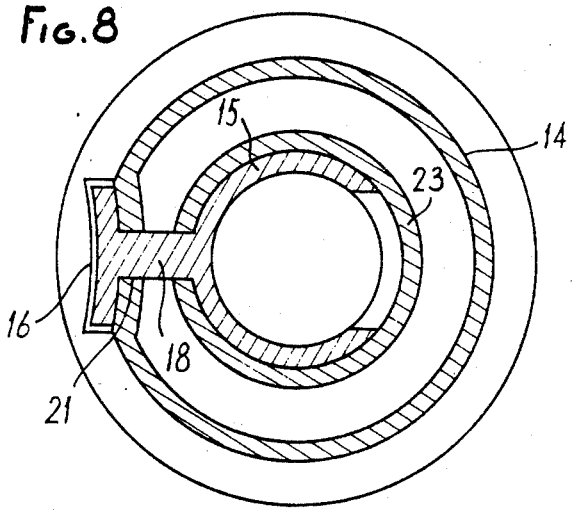
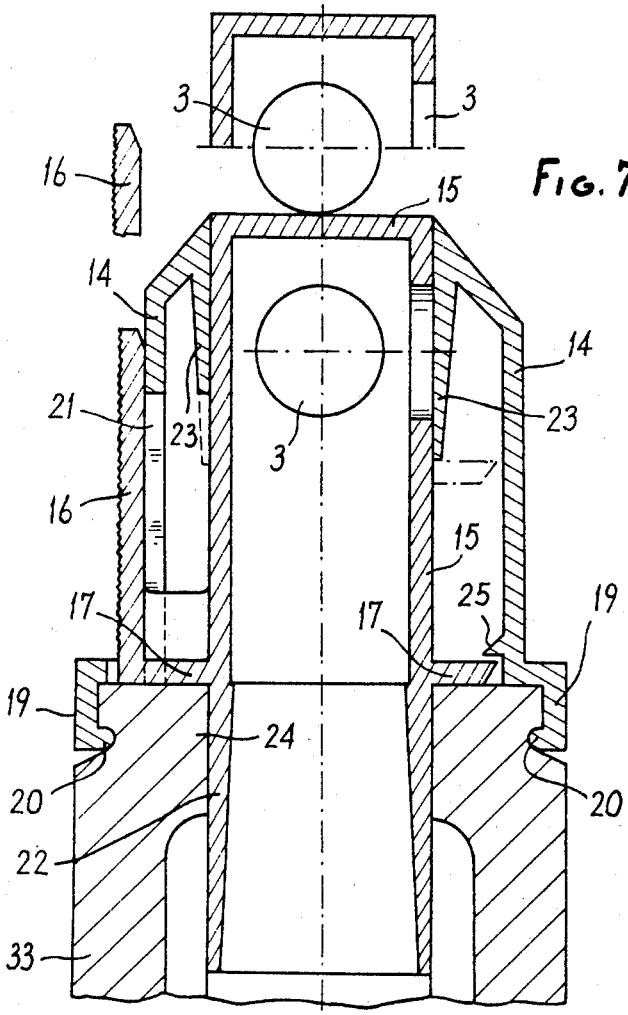
FIG. 7
FIG. 9
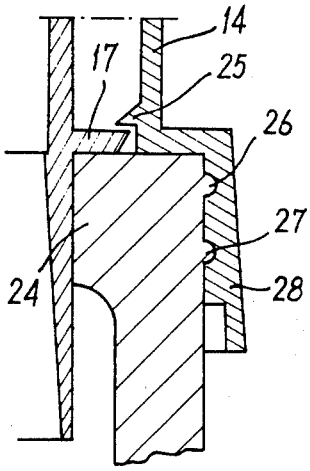

FIG. 10
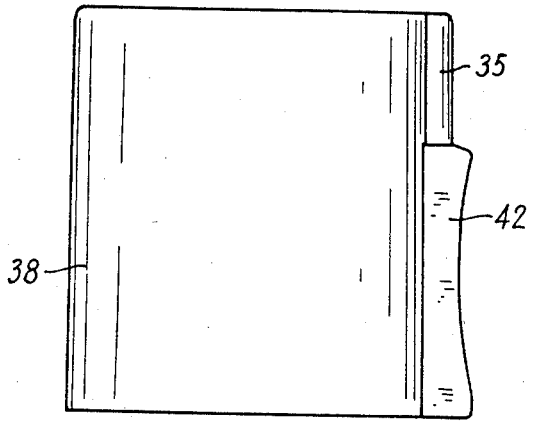
FIG. 11
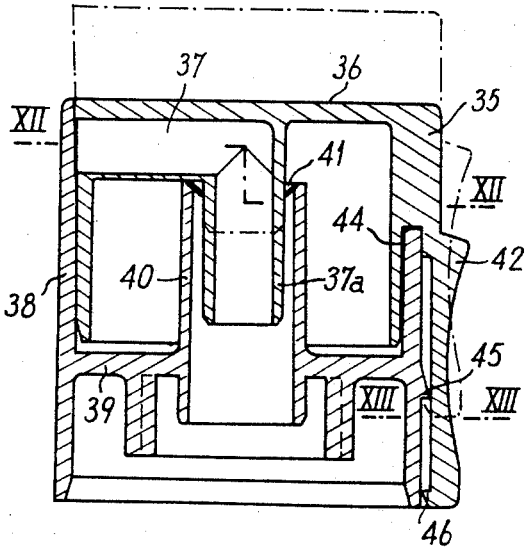
FIG. 12
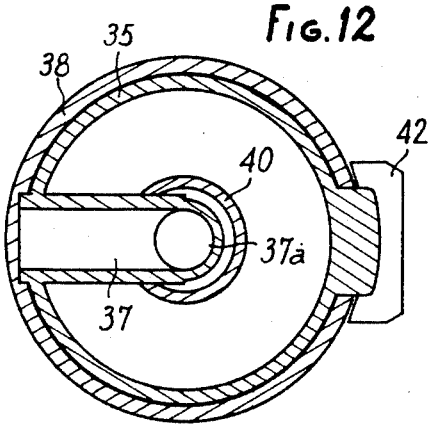
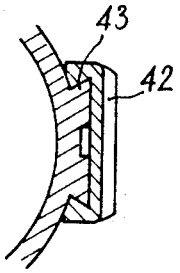
FIG. 13

TELESCOPIC CAPSULE FOR TUBES OR FLASKS

FIELD OF THE INVENTION

The present invention relates to a telescopic capsule for a tube or flask containing a liquid, a paste or a cream, such a capsule remaining attached to this tube or flask in the opened and closed positions.

SUMMARY OF THE INVENTION

According to the invention, the telescopic capsule for tubes or flasks comprises a telescopic tube obturated by a top forming plate formed with a lateral aperture for passage, in an opened position, of a product contained in the tube or flask, the telescopic tube sliding in a ring or envelope of the tube or flask, and the telescopic tube being rigidly connected to an operating push-piece movable in a guide means and being provided with at least one stop protrusion for preventing an ejection of said telescopic tube.

Various other features of this invention will become more apparent from the following detailed description.

BRIEF DESCRIPTION OF THE DRAWINGS

Embodiments of the invention are shown, by way of non limiting examples, in the accompanying drawings, wherein:

FIG. 7 is a vertical cross sectional view of another variant of embodiment of the telescopic capsule of the invention;

FIG. 8 is a cross sectional view of FIG. 7;

FIG. 9 is a partial cross sectional view illustrating a variant of embodiment of the telescopic tube of FIG. 7 for a screw capsule;

FIG. 10 is a side elevation view of still another variant of embodiment of the telescopic capsule;

FIG. 11 is an elevation cross sectional view corresponding to FIG. 10;

FIG. 12 is a cross sectional view taken along line XII—XII of FIG. 11;

FIG. 13 is a cross sectional view taken substantially along line XIII—XIII of FIG. 11.

DESCRIPTION OF THE PREFERRED EMBODIMENTS

Figure 1:
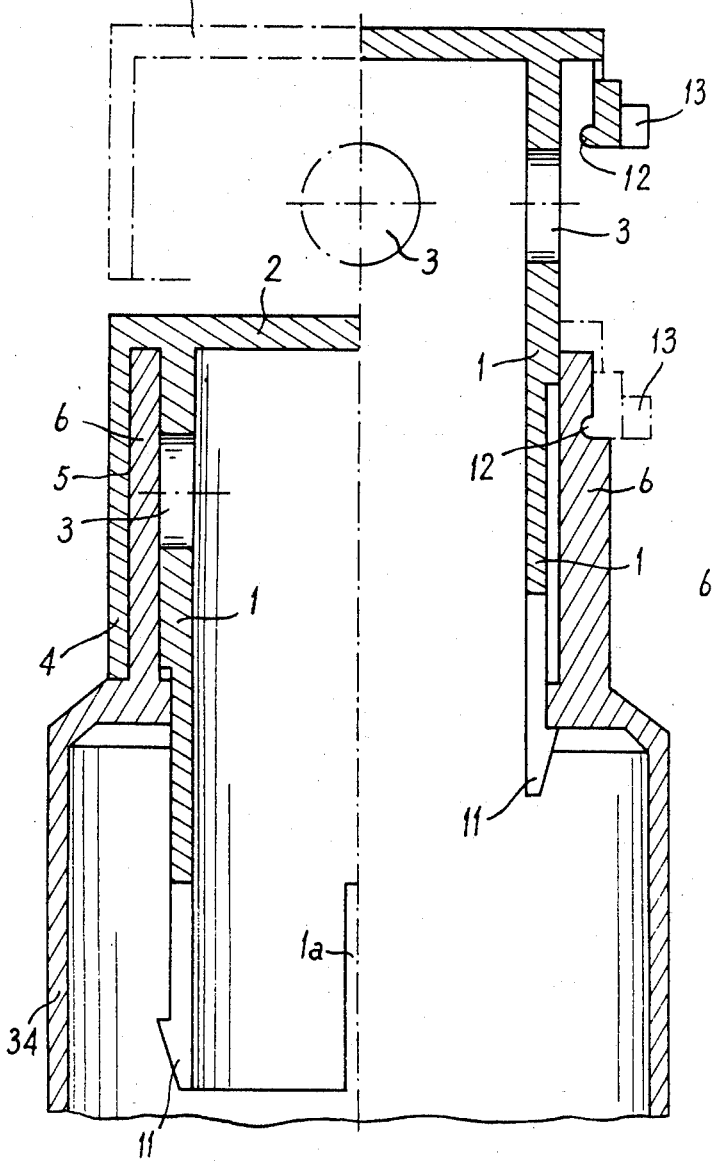
FIG. 1 is a vertical cross sectional view of a first embodiment of the telescopic capsule for tubes or flasks in two characteristic positions.
Figure 3:
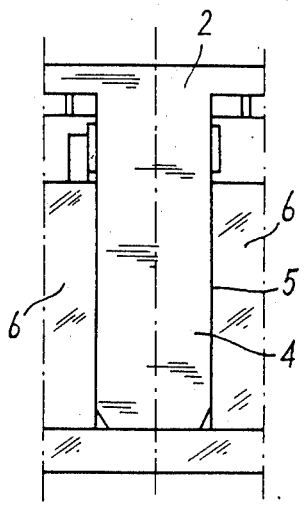
FIG. 3 is a partial elevation view of the capsule of FIG. 1.
Figure 2:
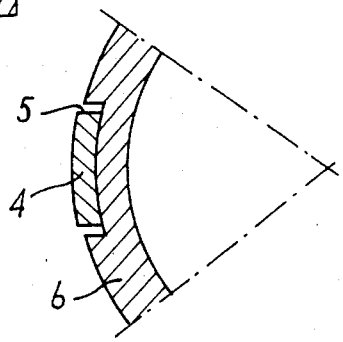
FIG. 2 is a partial cross sectional view illustrating a detail of embodiment.

According to FIGS. 1, 2 and 3, the telescopic tube 1 obturated by a top forming plate 2 is provided adjacent its upper portion, with a lateral aperture 3 for passage of the product, and the plate 2 comprises a push-piece formed by a male guiding element 4 sliding into a female groove 5 of a ring 6 of the tube or flask 34. The plate 2 comprises a violation-proof ring 13 with, at its lower portion, a snap-in retaining bead 12 engaging an outer groove of the ring 6.

A protruding edge 11 is provided at end of the telescopic tube 1, which protruding edge 11 forming, when it has been introduced in the tube or flask 34 through the ring 6, a stop surface for preventing ejection of the tube 1 once it has been mounted.

Figures 4, 5, 6:
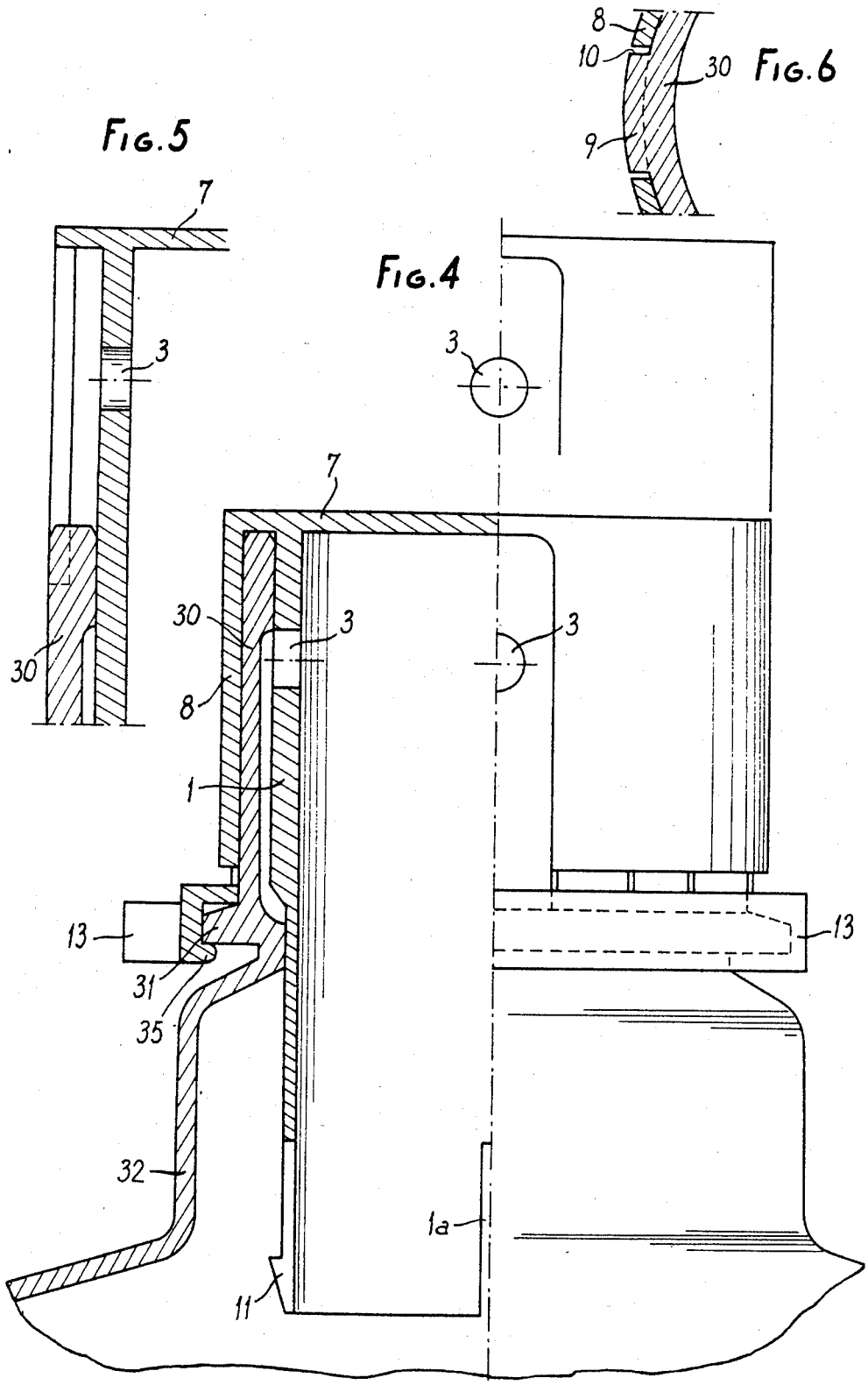
FIG. 4 is a vertical elevation cross sectional view of a variant of embodiment of the telescopic capsule according to the invention.
FIG. 5 is a partial vertical cross sectional view of the variant of FIG. 4, with an outlet aperture in an opened position.
FIG. 6 is a partial cross sectional view of FIG. 4.

According to an alternative embodiment shown in FIGS. 4, 5 and 6, the telescopic tube 1 comprises a top forming plate 7 rigidly connected to a sheathing skirt 8 provided with a vertical slot 10. The sheathing skirt 8, which is used for operating the telescopic tube 1, slides along a male thread 9 of the ring 30.

In this embodiment, a violation-proof ring 13 having a retaining bead 35 comes in a snap-in engagement underneath the lower portion of an outer flange 31 provided at bottom of the ring 30 of the tube or flask 32.

For the mounting operation, the telescopic tube 1 is positioned inside the ring 6 or 30 of the tubes or flasks 32 or 34 by means of the guiding element 4 and groove 5, and respectively by means of the slot 10 of the skirt 8 cooperating with the male thread 9.

The protruding edge 11 is retracted during passage in the ring 6 or 30, and then expands again, thereby preventing the telescopic tube 1 from moving out. Slots 1*a* formed at bottom of the telescopic tube 1 facilitate the hereabove described setting in position. Tightness is provided by the telescopic tube 1 being clamped in the rings 6 or 30 and, during the storage period, the violation-proof ring ensures a perfect hold.

For using the device, the violation-proof ring 13 is removed and a vertical traction is applied via the push-piece 4 or sheathing skirt 8 for disengaging the product outlet aperture 3. Thereafter, the tube or flask is pressed in order to discharge the product. Then, the top forming plate 2 is pushed in order to bring the telescopic tube 1 back inside the ring 6 or 30.

According to FIGS. 7, 8 and 9, in a third embodiment, the device comprises a telescopic tube 15 associated with a sheathing envelope 14. The obturated telescopic tube 15 has, adjacent its median portion, a ring 17 supporting a control lever 16 to which it is rigidly connected via a vertical flange 18. The lower portion of the tube 15 forms a sealing skirt 22 forming a seal with the ring 24 of the tube or flask 33. The sheathing envelope 14, which is opened at its upper end, is flush with the top forming plate 2 of the telescopic tube 15. An inner sealing skirt 23 envelopes the upper portion of the telescopic tube 15 and, in the closed position of the telescopic tube 15, closes the product outlet aperture 3.

On its outer periphery, the sheathing envelope 14 is provided with a vertical cut-out portion 21 for passage of the vertical flange 18 supporting the control lever or push-piece 16 of the telescopic tube 15. At the lower portion, the sheathing envelope 14 is provided with a ring 19 having a snap-in bead 20 thereby fixing the sheathing envelope 14 on the ring 24. A rib 25 inside the sheathing envelope 14 maintains the ring 17 in the lower position but its small height enables it to easily disengage the ring 17 when the device has to be opened; in its high position, the ring 17 abuts against the lower end of the sealing skirt 23.

For the mounting operation, the lower sealing skirt 22 is positioned inside the ring 24 until it bears on the central ring 17. The envelope 14 is oriented such that the control lever or push-piece 16 of the telescopic tube 15 is housed in the vertical cut-out portion 21 of the sheathing envelope; the latter is then tightly engaged on the ring 24 via the snap-in bead 20 of the ring 19.

Tightness is provided by the seal forming skirt 22 inside the ring 24 for the lower portion of the telescopic tube 15, and by the seal forming skirt 23 of the envelope for the upper portion of the telescopic tube 15.

The device is used by pushing upwardly the lever or push-piece 16 for controlling the outlet of the telescopic tube 15 above the envelope 14, thereby disengaging the product outlet aperture 3.

When a pressure is exerted on the tube or flask, the product flows out on the side opposite the control lever 16.

By moving the lever 16 down, the telescopic tube 15 returns inside the envelope 14.

In the alternative embodiment of FIGS. 10 to 13, the telescopic tube 35 is closed by a top forming plate 36 and defines a square-shaped duct 37 opening laterally, in the same manner as the lateral aperture 3 of the above mentioned embodiments.

The telescopic tube 35 can slide inside an envelope 38 forming a transverse wall 39 supporting a nipple 40 provided with lips or other sealing formations 41 bearing against the outer surface of a portion 37*a* of the duct 37.

A push-piece 42 protrudes laterally from the telescopic tube 35 and the push-piece 42 is connected to the envelope 38, for example via a dovetail arrangement 43 as shown in FIG. 13.

The push-piece 42 is placed outside a cut 44 defined by the telescopic tube 35 for partially overlapping the envelope 38. Moreover, abutments 45, 46 are provided on the envelope 38 and telescopic tube 35 for limiting the stroke of the telescopic tube 35.

The envelope 38 can be directly fixed on the bottle or flask.

It is obvious that detail modifications can be carried out on the above embodiments without departing from the scope of the present invention.

What we claim is:

1. A telescopic capsule comprising:

a telescopic tube comprising a top forming plate for closing said telescopic tube and an inner portion defining a square-shaped duct having one end opening laterally;

an envelope adapted to slidably receive said telescopic tube and having a transverse wall;

a nipple supported by said transverse wall and adapted to receive a second end of said square-shaped duct;

an operating push-piece formed by a downardly lateral outer extension of said telescopic tube; and guide means provided on said envelope for moveably guiding said push-piece;

a first stop protrusion on said guide means;

a second portrusion on said push-piece adapted to abut against said first stop protrusion to prevent extraction of said telescopic tube from said envelope;

a cut portion defined by said telescopic tube adapted to receive said guide means when said telescopic tube is in a downward position, said cut portion being covered outwardly by said push-piece.

2. The telescopic capsule according to claim 1, further comprising seals provided on said nippled adapted to connect a wall of said nipple to a portion of said square-shaped duct extending inside said nipple.

3. The telescopic capsule according to claim 1, wherein said push-piece is connected to said envelope by a dovetail arrangement.

* * * * *